US005178075A

United States Patent [19]

Kanazawa

[11] Patent Number: 5,178,075

[45] Date of Patent: Jan. 12, 1993

[54] ASSEMBLED PALLET FOR FORKLIFT

[76] Inventor: Okimune Kanazawa, No. 8-4, Higashi-Honjoji, Sanjo-shi, Niigata-ken, Japan

[21] Appl. No.: 728,497

[22] Filed: Jul. 11, 1991

[30] Foreign Application Priority Data

Feb. 22, 1991 [JP] Japan ..... 3-28760

[51] Int. Cl.[5] ..... B65D 19/44

[52] U.S. Cl. ..... 108/56.1; 108/902

[58] Field of Search ..... 108/56.1, 51.1, 901, 108/902, 54.1

[56] References Cited

U.S. PATENT DOCUMENTS

| | | | |
|---|---|---|---|
| 2,783,960 | 3/1957 | Herz et al. | 108/56.1 |
| 3,868,915 | 3/1975 | Hafner | 108/51.1 |
| 4,062,301 | 12/1977 | Pitchford | 108/56.1 |
| 4,287,836 | 9/1981 | Aoki | 108/51.1 |
| 4,393,999 | 7/1983 | Forshee | 108/55.3 X |
| 4,397,246 | 8/1983 | Ishida et al. | 108/55.3 |
| 4,774,892 | 10/1988 | Ballard et al. | 108/55.3 |

FOREIGN PATENT DOCUMENTS

| | | | |
|---|---|---|---|
| 2713674 | 10/1977 | Fed. Rep. of Germany | 108/55.3 |

*Primary Examiner*—José V. Chen

*Attorney, Agent, or Firm*—Sughrue, Mion, Zinn, Macpeak & Seas

[57] ABSTRACT

An assembled pallet for a forklift is disclosed which is made of plastic. A number of divided pallet members each formed of plastic by dividing a square by two diagonal lines are produced on a mass production basis. Four divided members are joined with each other through joint connections. The assembled pallet has, at each side, right and left two fork insertion holes through which the fork of the forklift may be inserted.

3 Claims, 10 Drawing Sheets

ASSEMBLED PALLET FOR FORKLIFT

BACKGROUND OF THE INVENTION

The present invention relates to an assembled pallet for a forklift, which pallet is used as a base for loading thereon laminated or overlapped articles to be transported by a forklift and is composed of a plurality of sectional members or segments.

In general, in this field, wooden pallets have been frequently used because metallic pallets are heavy. However, the wooden pallets are still relatively heavy and are inferior in durability. Thus, plastic pallets have been used in some cases.

The size of the pallet for the forklift depends upon the size of the forklift and the size of the articles or cargo to be loaded thereon. In order to manufacture ordinary size pallets by plastic molding machines, an expensive molding machine having a large capacity would be needed, resulting in an increase of the manufacture cost.

For this reason, it has been proposed to join or assemble segments or parts of the pallet with each other in order to manufacture the segments using a small capacity molding machine. If, however, the parts divided in parallel are simply assembled or joined with each other, fork holes should be formed in a direction perpendicular to the divisional direction thereof. It should be noted that, in case of a fourth direction insertion pallet, the other fork holes must extend in the divisional direction, which leads to the decrease in mechanical strength for the load.

Also, the conventional pallets suffer from problems in that it would be difficult to change the square pallet to the rectangular pallet and it would be difficult to effectively reinforce the pallet.

SUMMARY OF THE INVENTION

An object of the invention is to provide an assembled pallet for the forklift which may overcome the foregoing disadvantages inherent in the prior art.

In order to attain this and other objects, according to the invention, there is provided an assembled pallet for a forklift, comprising four divided pallet members, each of which is formed of a plastic material in the form of an isosceles triangle having a right angle at its apex so that the four divided pallet members are formed by dividing a square by two diagonal lines; a female connection convex portion and a male connection convex portion being formed at both end portions of a divided face of one of oblique sides of one of the plastics made divided pallet members; a male connection concave portion and a female connection concave portion being formed at positions, corresponding to the female connection convex portion and the male connection convex portion, of the opposite side thereof; right and left pairs of fork insertion holes being formed in a longitudinal direction perpendicular to a bottom of the triangle between the female connection convex portion and the male connection convex portion and between the male connection concave portion and the female connection concave portion of the divided pallet member; and a single intersecting fork insertion hole being formed in a lateral direction in parallel to the bottom between the female connection convex portion and the male connection concave portion near the apex portion and the male connection convex portion and the female connection concave portion near to the bottom; whereby the four plastic made, divided pallet members having the same shape are assembled into the square pallet with the female connection convex portions being engaged with the adjacent male connection concave portions and the male connection convex portions being engaged with the adjacent female connection concave portions, so that a fork of the forklift may be inserted into the pallet.

According to another aspect of the invention, there is provided an assembled pallet for a forklift, wherein right angle isosceles-triangular, divided pallet members each formed by dividing a square by diagonal lines are made of plastic material; a square pallet member made of plastic material is assembled by joint connections so as to have fork insertion holes; and an additional pallet member made of a plastic material and having communication holes corresponding to the fork insertion holes of the square pallet member and having the same thickness and width as those of the square pallet member is provided at least one side of two facing sides of the square pallet member to thereby provide a rectangular pallet member by joint connections.

According to another aspect of the invention, there is provided an assembled pallet for a forklift, wherein right angle isosceles-triangular, divided pallet members each formed by dividing a square by diagonal lines are made of plastic material; a square pallet member made of plastic material is assembled by joint connections so as to have fork insertion holes; and at least one plate-like flexible material such as a rubber plate is interposed between facing surfaces of joints of the square pallet member with an upper edge of plate-like flexible material being projected slightly above a top surface of the square pallet member to effect slippage prevention along the diagonal lines.

According to still another aspect of the invention, there is provided an assembled pallet for a forklift, wherein right angle isosceles-triangular, divided pallet members each formed by dividing a square by diagonal lines are made of plastic material; a square pallet member made of plastic material is assembled by joint connections so as to have fork insertion holes; and metallic strip plates are provided at an upper portion of the pallet member so as to intersect with the fork insertion holes of the square pallet member with its widthwise direction of the metallic strip plates being directed in the vertical direction and the strip plates extending from one edge to the other edge of the pallet member.

According to the first aspect of the invention, the square is divided by two diagonals and the female connection convex portion is engaged with the male connection concave portion and the male connection convex portion is engaged with the female connection concave portion under the condition that the respective apex portions of the four divided pallet members having the right and left two fork insertion holes in the longitudinal direction and the single fork insertion holes in the lateral direction are aligned with each other. The four pallet members are assembled through joint connections. As a result, the fork of the forklift may be inserted in any direction of four directions. Thus, there is provided a square pallet having right and left two fork insertion holes on each side.

According to the second aspect of the invention, the additional pallet member is joined with at least one side or two confronting sides of the plastic made square pallet, thereby forming a rectangular assembled pallet for a forklift.

According to the third aspect of the invention, the plate-like flexible material is interposed between the joint portions of the square pallet member, with its upper edge being projected slightly above the top surface of the pallet, and the slippage preventing strips are formed along the diagonal liens of the square pallet member, thus preventing the articles loaded on the pallet from being slipped due to the pressure applied from the articles to the pallet.

According to the fourth aspect of the invention, metallic strip plates intersecting with the fork insertion holes are formed on the upper portion of the pallet with its width direction being directed vertically, thereby forming load reinforcement strips extending from a right edge to a left edge of the pallet. As a result, it is possible to prevent the square pallet member from being warped or deformed downwardly due to the load imposed from above when the articles are loaded on the square pallet.

DESCRIPTION OF THE PREFERRED EMBODIMENTS

Figure 1:
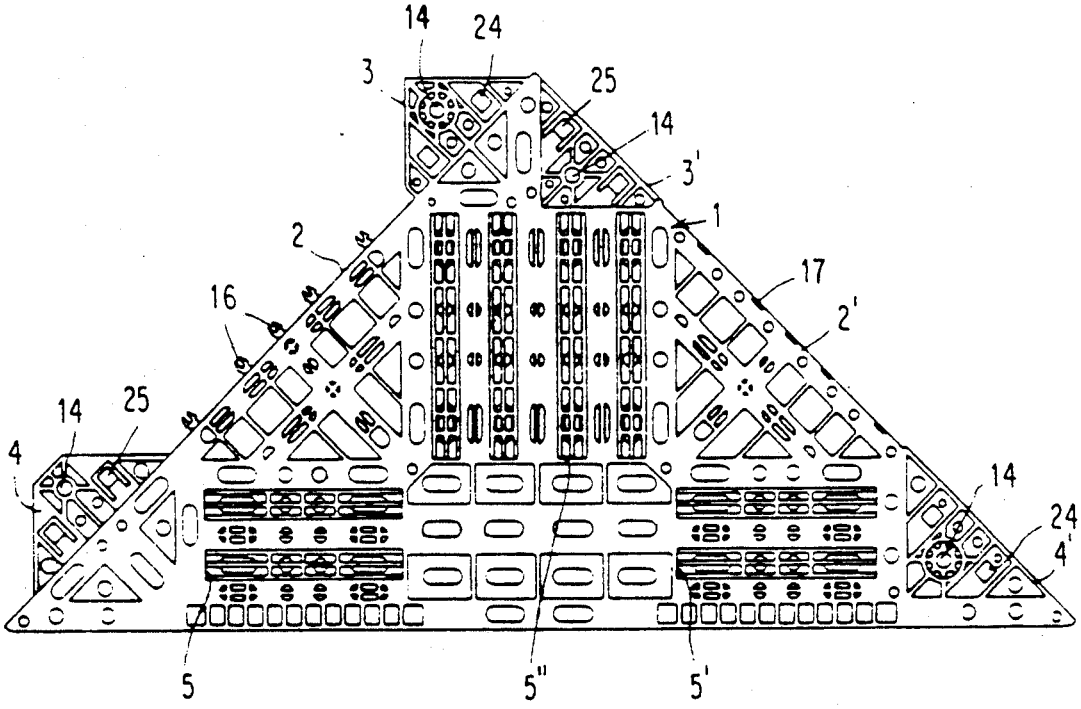
FIG. 1 is a plan view showing a divided pallet member according to the present invention.
Figure 2:
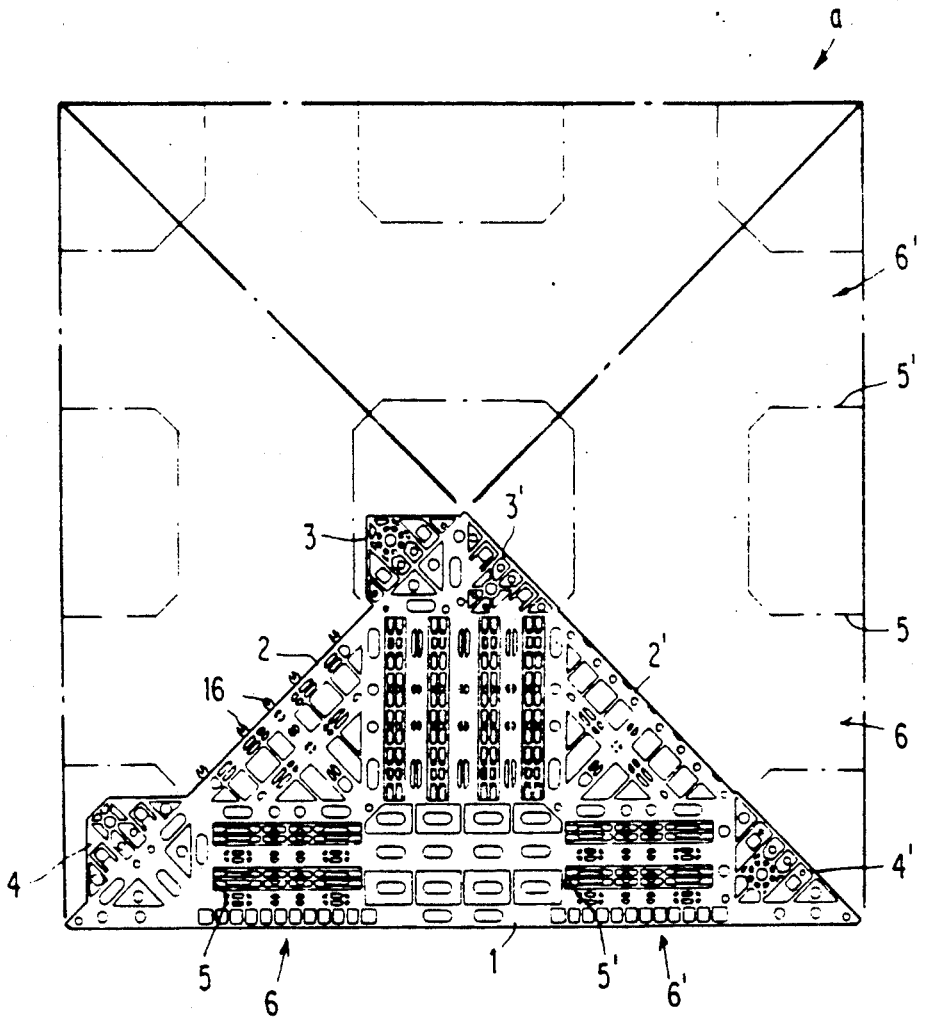
FIG. 2 is a plan view illustrating a joint condition of four divided pallet members according to the present invention.
Figure 3:
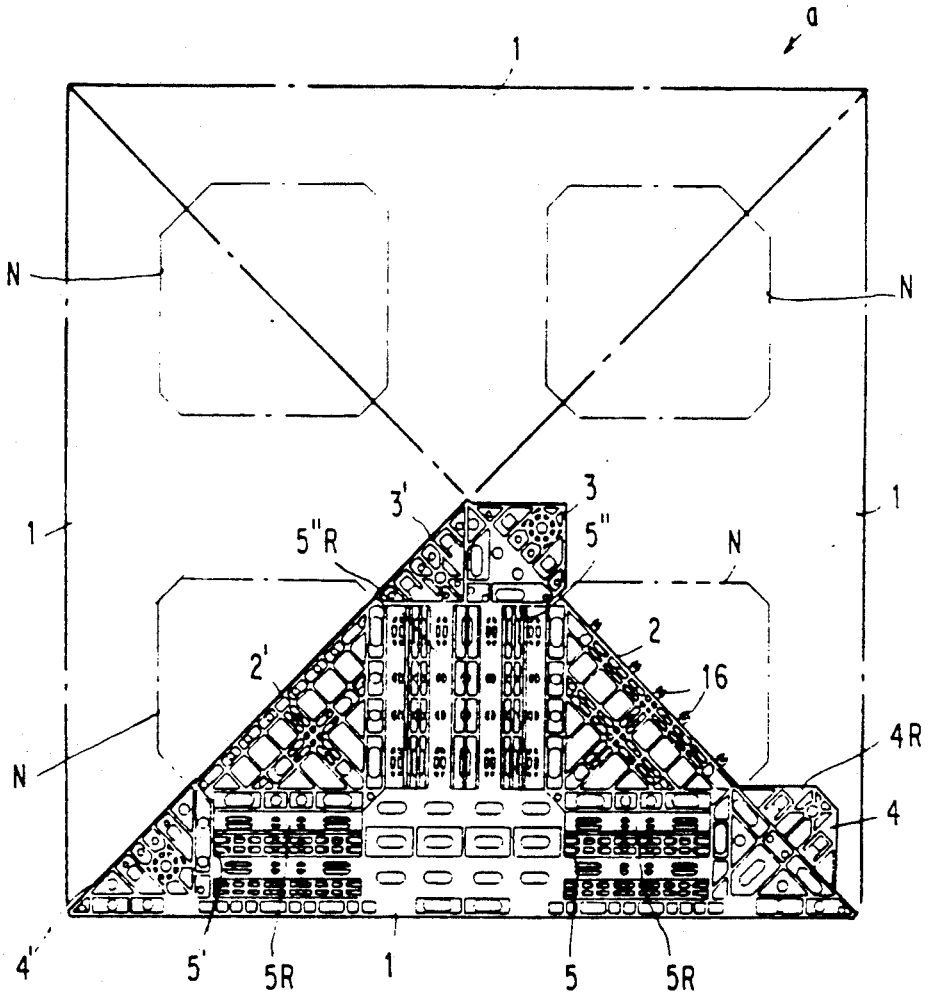
FIG. 3 is a bottom view showing the joint condition of the four pallet members shown in FIG. 2.
Figure 4:
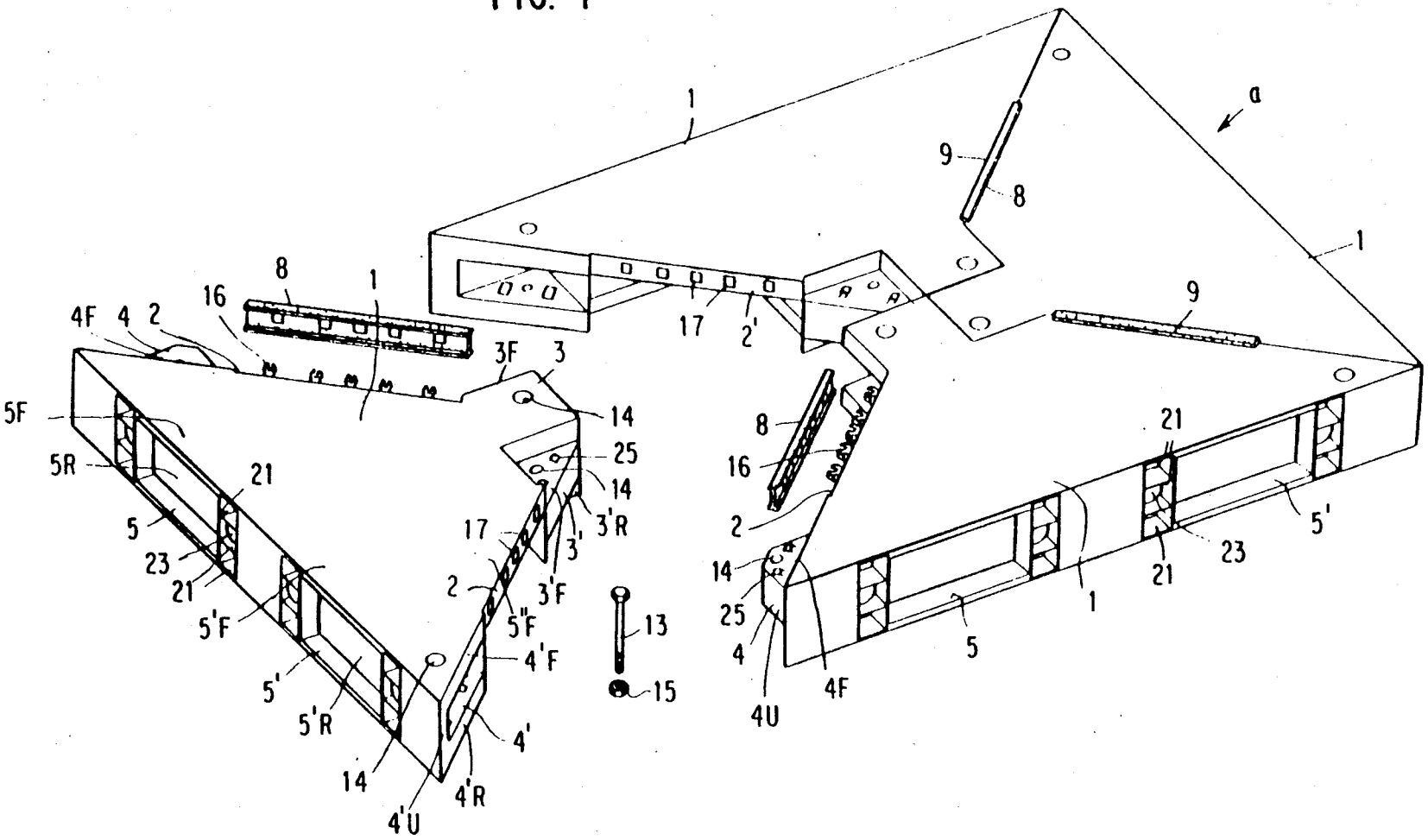
FIG. 4 is an exploded view showing the joint condition of the square pallet members from which the gaps or holes for weight reduction have been omitted.

The accompanying drawings show an embodiment of the invention. FIGS. 1 to 3 show its complete actual structure but FIGS. 4 through 16 schematically show the embodiment while limiting gaps and holes for reduction of weight, for the sake of easily understanding the structure.

Reference is first made to FIG. 1. A first male connection portion 3 has an upper plate 3F and a lower plate 3R each having a triangular shape formed by dividing a regular square. The upper and lower plates 3F and 3R project from upper and lower edges of an oblique left side at an apex portion of a divided pallet member 1. On the other hand, a first female connection portion 3' has upper and lower spaces 3'F and 3'R into which the associated upper and lower plates 3F and 3R of the first male connection portion are engaged, respectively. The spaces 3'F and 3'R are defined on the upper and lower edges of an oblique right side at the apex portion of the divided pallet member 1.

A second male connection portion 4 projecting from the lower end portion of the oblique left side has an upper space 4F and a lower space 4R at the upper and lower edge sides of the divided pallet member 1 and has a bottom space 4U on its bottom edge side, with its apex portion being cut away. On the other side, a second female connection portion 4' formed at the end portion of the oblique right side of the divided pallet member 1 has an upper wall 4F', a lower wall 4'R and a bottom wall 4'U.

Right and left, two fork insertion holes 5 and 5' and single perpendicular fork insertion hole 5'' have upper walls 5F, 5'F and 5''F and lower walls 5R, 5'R and 5''R, and are so arranged as to form a regular square N as shown in FIG. 3 (see FIG. 13) as viewed from the rear side by omitting the triangular part defined by the intersection between the two fork insertion holes 5 and 5' and the single perpendicular fork insertion hole 5''.

Also, in order to reduce the overall weight as much as possible, and to save the plastic material, cross-pieces are used in parallel or a number of holes are opened by molding. Such a fine structure may be exactly formed by using polypropylene resin or polyethylene resin.

The engagement connection between the first male connection portion 3 and the first female connection portion 3' and the engagement connection between the second male connection portion 4 and the first male connection portion 4' are securely fixed by inserting connection bolts 13 into bolt holes 14 and threadly fastening nuts 15.

A plurality of engagement projections 16 are formed on the divided surface 2 of the one oblique side (i.e., the oblique left side in FIG. 1) of the divided pallet member 1. A plurality of associated engagement holes 17 for preventing the engagement projections 16 from pulling apart therefrom are formed in the divided surface 2' of the opposite oblique side. Furthermore, two rectangular engagement holes 24 are formed in the upper plate 3F and the lower plate 3R of the second female connection portion 3, respectively, and also, two rectangular engagement holes 24 are formed in the upper plate 4'F and the lower plate 4'R of the second female connection portion 4'. The rectangular engagement pieces 25 for engagement under the pull-apart preventing condition with the respective rectangular engagement holes 24 are formed on the top and rear surfaces of the first female connection portion 3' and the second male connection portion 4. It is thus possible to firmly engage and fix four divided pallet members 1 in unison.

Figure 15:
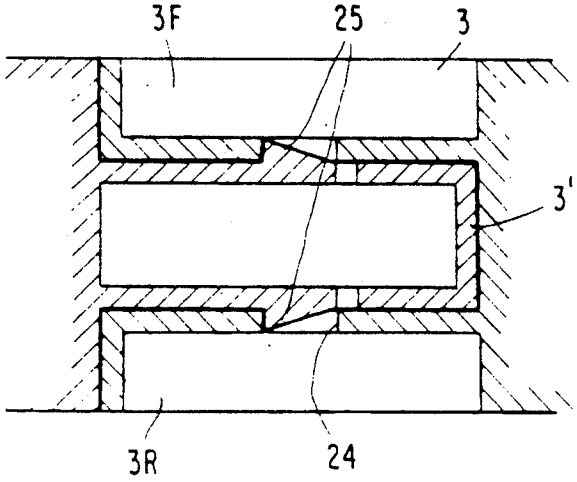
FIG. 15 is a cross-sectional view showing the engagement condition of the female connection convex portion and the male connection concave portion.
Figure 16:
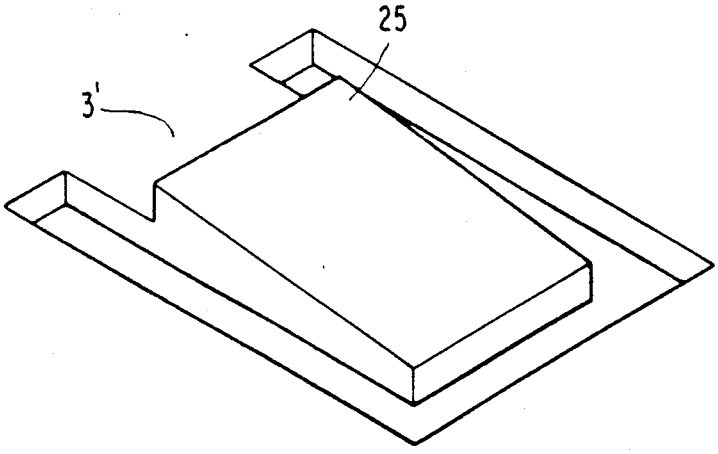
FIG. 16 is a perspective view showing the male connection concave portion.

FIG. 15 is a cross-sectional view showing the engagement between rectangular engagement piece 25 of the first male connection portion 3 and rectangular engagement holes 24 of the first female connection portion 3' (which engagement is the same as the engagement between rectangular engagement pieces 25 of the second male connection portion 4 and rectangular engagement holes 24 of the second female connection portion 4'. FIG. 16 is a perspective view showing the rectangular engagement piece 25. It is also noted that the engagement between the engagement projections 16 and the engagement holes 17 is the same as the engagement between the rectangular engagement pieces 25 and the rectangular engagement holes 24.

Figure 5:
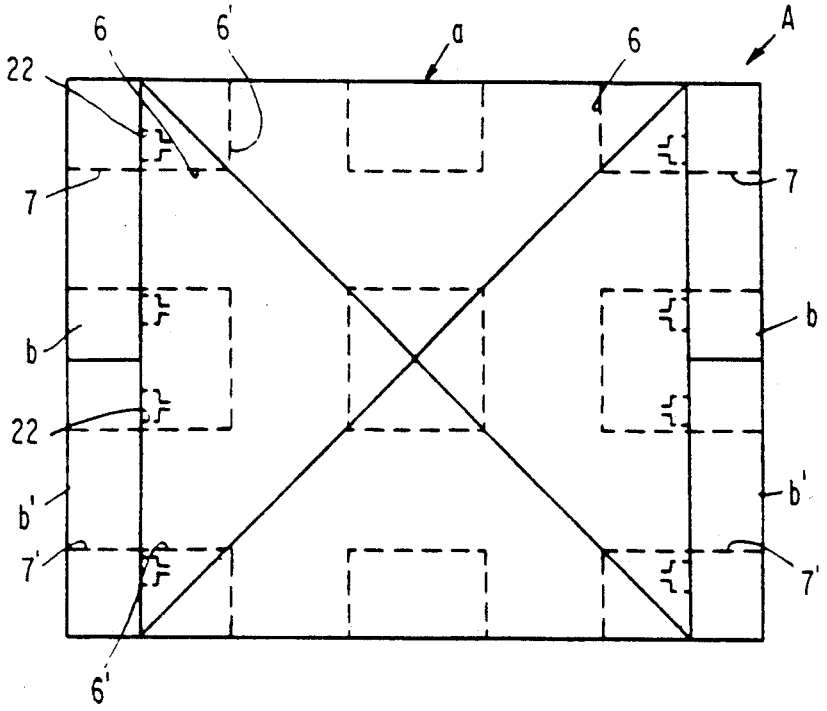
FIG. 5 is a plan view showing a rectangular pallet member formed by joining the additional pallet members with the square pallet member according to another aspect of the invention.

FIG. 5 shows the joint with additional pallet members b. In this case, four additional pallet members b and b' are joined with both sides of the square pallet member a with each two additional pallets being arranged on a line on one side (However, one integrally formed additional pallet member b, b' which is twice as large as a length of the short pallet member b, b' may be arranged on each side of the square pallet member a). Four connection portions each having three joint recesses 21 arranged in the vertical direction are formed on both sides of the fork insertion holes 5 and 5' of the divided pallet member 1. Two associated connection portions each having engagement projections 22 arranged in the vertical direction for engagement with the joint recesses 21 are formed in each of the four additional pallet member b and b'. The upper and lower joint projections 22 are provided with engagement projections 26 like the above-described engagement projections 16 and the rectangular engagement pieces 25, whereas the associated joint recesses 21 are provided with engagement holes (not shown) like the above-described the engagement holes 17 and the rectangular engagement holes 24. Thus, the joint projections 22 and the associated joint recesses 21 are engaged with each other. Screw holes 23 are formed in the central joint recess 21 and the joint projection 23. Then, these portions are firmly fastened by means of a bolt and nut connection.

Figure 6:
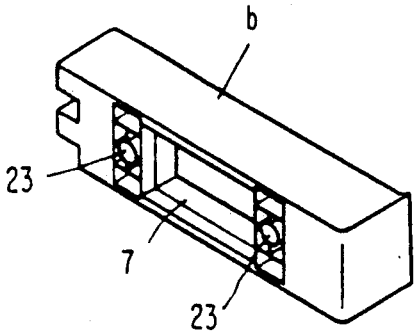
FIG. 6 is a perspective view showing the additional pallet member.
Figure 14:
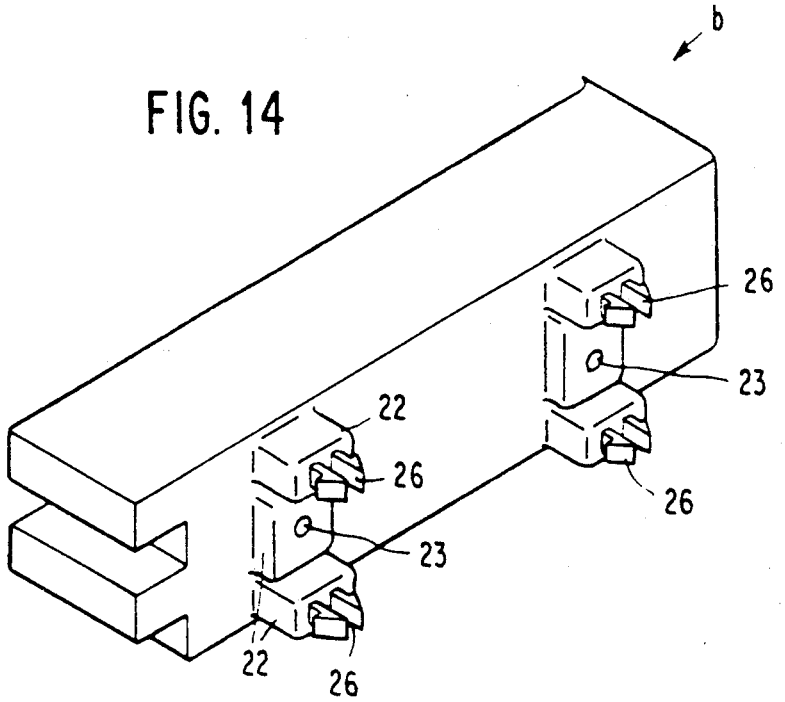
FIG. 14 is a perspective view showing the additional pallet member.

FIG. 14 is a perspective view showing the connection between the additional pallet member b (or b') and the divisional pallet 1. FIG. 6 is a perspective view showing the opposite associated side of the additional pallet b to the connection shown in FIG. 14.

Figure 7:
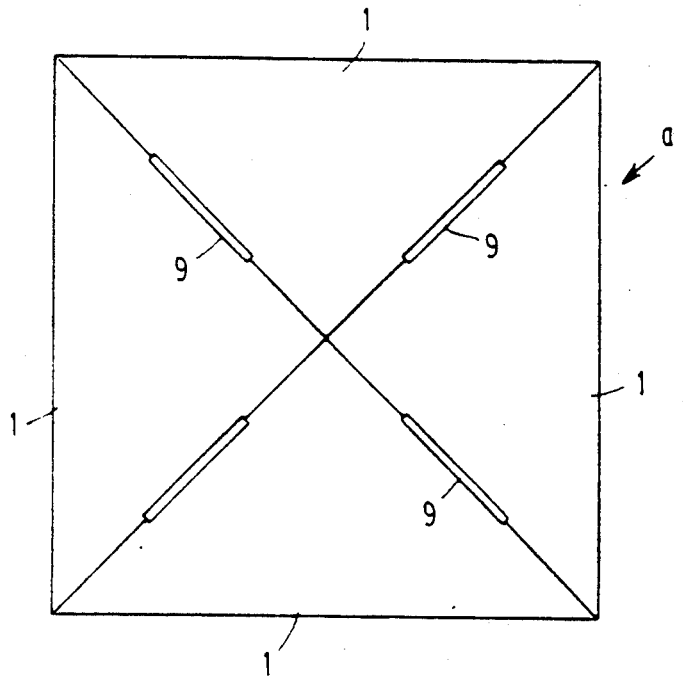
FIG. 7 is a plan view showing the square pallet member provided with the slippage preventing strips.
Figure 8:
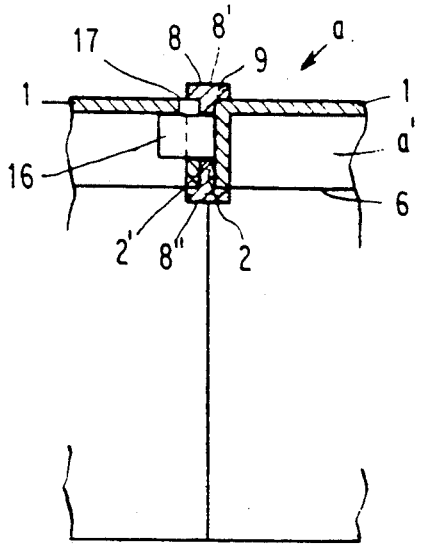
FIG. 8 is a cross-sectional view showing a primary part of FIG. 7.
Figure 9:
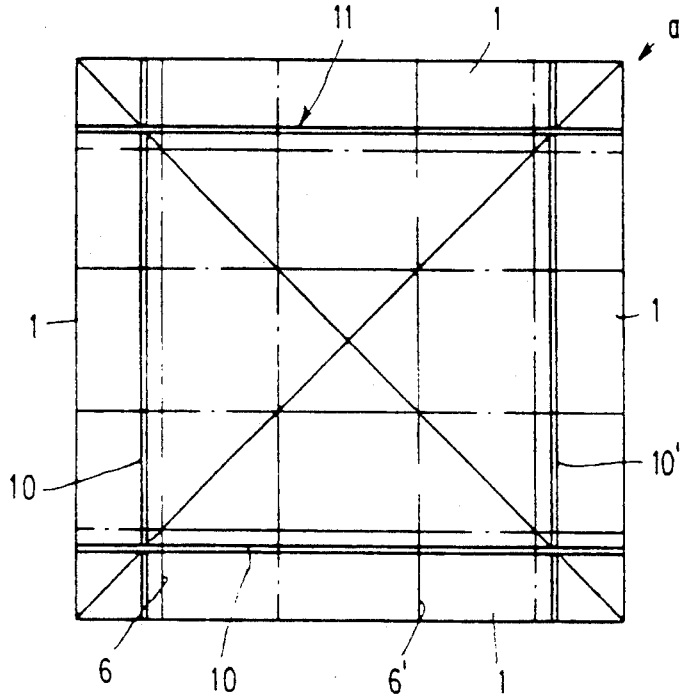
FIG. 9 is a plan view showing the square pallet member provided with metallic strip plates.
Figure 10:
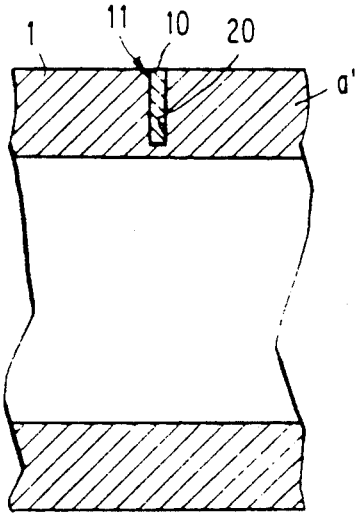
FIG. 10 is a cross-sectional view showing a primary part of FIG. 9.

As shown in FIGS. 7 and 8, if planar flexible materials 8 having an I-shape in cross section is interposed in an intermediate portion of a joint portion of a pallet member upper portions a' of the adjacent divided pallet members 1 (it is possible to provide the material over all the joint portion but it is also possible to provide the material only in the intermediate joint portion or at several portions at an interval), an upper jaw portion 8' of the I-shaped rubber plate is located above the top surface of the plastic made square pallet member a, thereby serving as a slippage preventing means for preventing the article, to be loaded on the plastic made square pallet member a. Also, the lower jaw portion 8" of the I-shaped rubber plate is located above the fork insertion hole 6 serves as a slippage preventing means for preventing the slippage between the pallet member a and the fork 19 of the forklift 18.

Figure 11:
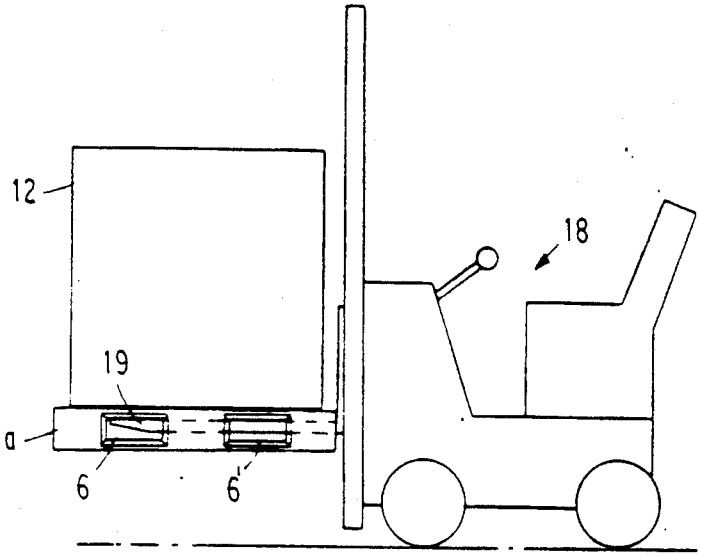
FIG. 11 is a side elevational view showing a forklift under the use condition of the square pallet members.
Figure 12:
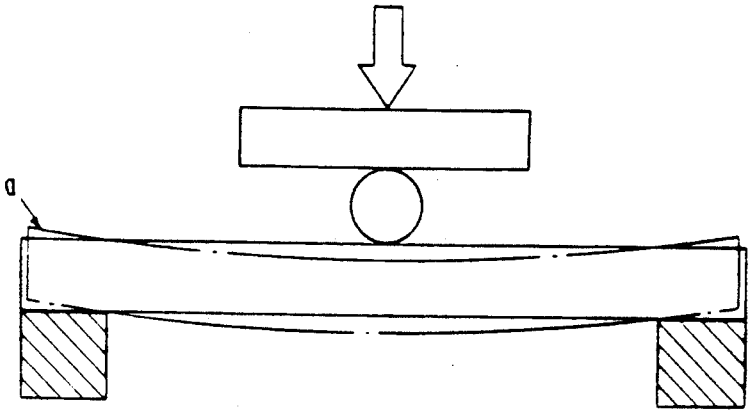
FIG. 12 is an illustration showing the load experiment of the square pallet member.
Figure 13:
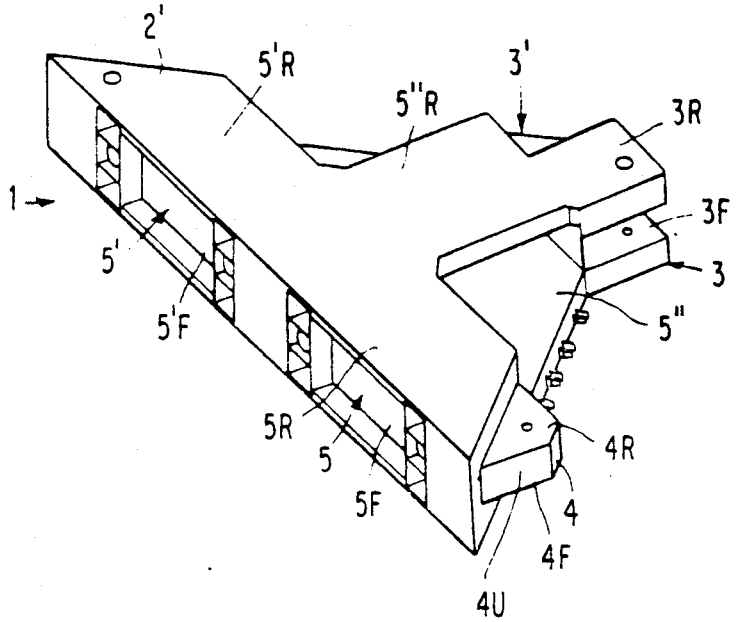
FIG. 13 is a perspective view showing the divided pallet member as viewed from the rear side.

By baking and forming metal strip plates 10 and 10' on the pallet member upper portion a' along upper side walls of the fork insertion holes 6 and 6' under the horizontal position of the pallet member, or by forming engagement grooves 20 and engaging the metal strip plates 10 and 10' into the engagement grooves 20 from one edge to the other of the square pallet member a, the load reinforcement strips 11 is formed. The load reinforcement strips may be formed in a serpentine manner as viewed from above. The load reinforcement strips are provided on the square pallet member a whereby when the articles 12 are loaded on the square pallet member a, as shown in FIG. 11, it is possible to prevent the square pallet member a from warping or deforming downwardly relative to the load imposed from above.

It is preferable to use the square pallet member a as described above, but it is also possible to use a square pallet member divided by one diagonal line into two segments. The divided two parts may be joined with each other by a suitable means.

As described above, according to the present invention, it is possible to make a number of divided pallet members having the same structure and the same size on a mass production basis by using a single molding machine having a smaller capacity than that of the conventional machine. Then, the four units of the divided pallet member are assembled to form a plastic square pallet which may be inserted by the fork in any direction of the four sides. In addition, the assembled pallet for a forklift is free from the corrosion and is light in weight and low in manufacture cost.

Also, it is possible to enlarge the square pallet to a rectangular pallet. Moreover, the article disposed on the pallet will not slide thereon. The pallet is durable against a large load for a forklift.

What is claimed is:

1. An assembled pallet for a forklift comprising:

four divided pallet members, each of which is formed of a plastic material in the form of an isosceles triangle having a right angle at its apex including a base disposed on the side opposite said apex and two oblique sides, each of said pallet members including a first male connection portion and a second male connection portion formed at both end portions of one of said oblique sides, a first female connection portion and a second female connection portion formed at positions, on the other of said oblique sides, corresponding to said first male connection portion and said second male connection portion, right and left dual fork insertion holes formed in a longitudinal direction perpendicular to said base and between said first male connection portion and said second male connection portion and between said first female connection portion and said second female connection portion and a single intersecting fork insertion hole formed in a lateral direction in parallel to said base between said first male connection portion and said first female connection portion near the apex portion and said second male connection portion and said second female connection portion near said base whereby the four pallet members are assembled into a square pallet with the first male connection portions being engaged with the adjacent first female connection portions and the second male connection portions being engaged with the adjacent second female connection portions, so that a fork of the forklift may be inserted into said fork insertion holes of the pallet.

2. The pallet of claim 1, further comprising:

an additional plastic pallet member having communication holes corresponding to said fork insertion holes of said divided pallet members; and connectors for connecting said additional pallet member to said base of at least one of said divided pallet members such that said communication holes are aligned with said fork insertion holes.

3. A pallet for a forklift, comprising:

four plastic pallet members each having the shape of an isosceles triangle having a right angle at its apex and including a base disposed on the side opposite said apex and two oblique sides, each of said pallet members having fork insertion holes;

first connectors for interconnecting said pallet members such that said pallet has a substantially square shape and said fork insertion holes are aligned to receive a fork of a forklift;

slippage preventing means for preventing an article to be loaded on said pallet from slipping, said slippage preventing means comprising an I-shaped rubber plate at least partially disposed between mating oblique sides of each of said pallet members with the top portion of said rubber plate protruding from said pallet.

* * * * *